US005942888A

United States Patent [19]

Tan

[11] Patent Number: 5,942,888

[45] Date of Patent: Aug. 24, 1999

[54] METHOD AND DEVICE FOR TEMPERATURE DEPENDENT CURRENT GENERATION

[75] Inventor: Nianxiong Tan, Sollentuna, Sweden

[73] Assignee: Telefonaktiebolaget LM Ericsson, Stockholm, Sweden

[21] Appl. No.: 08/848,247

[22] Filed: Apr. 29, 1997

[30] Foreign Application Priority Data

May 7, 1996 [SE] Sweden ..... 9601748

[51] Int. Cl.[6] ..... G05F 3/20; G05F 3/16

[52] U.S. Cl. ..... 323/315; 323/309; 323/313

[58] Field of Search ..... 323/907, 315, 323/314, 313; 307/475

[56] References Cited

U.S. PATENT DOCUMENTS

| | | | |
|---|---|---|---|
| 4,473,793 | 9/1984 | Blackmer et al. | 323/311 |
| 4,645,948 | 2/1987 | Morris et al. | 307/296 |
| 5,068,595 | 11/1991 | Kearney et al. | 323/316 |
| 5,266,885 | 11/1993 | Brambilla et al. | 323/313 |
| 5,334,929 | 8/1994 | Schade, Jr. | 323/315 |
| 5,391,980 | 2/1995 | Thiel et al. | 323/314 |
| 5,627,456 | 5/1997 | Novof et al. | 323/315 |

FOREIGN PATENT DOCUMENTS

| | | | |
|---|---|---|---|
| 0 504 983 | 9/1992 | European Pat. Off. | G05F 3/24 |
| WO95/22093 | 8/1995 | WIPO | G05F 3/24 |

OTHER PUBLICATIONS

CMOS Analog Circuit Design, Allen, Phillip E. et al., Holt, Rinehart and Winston Inc., 1987, 6 pages referencing § 11.1.

Analysis and Design of Analog Integrated Circuits, Gray, Paul R. et al., 3rd Ed. John Wiley & Sons, Inc., 1993, pp. 338–345.

*Primary Examiner*—Peter S. Wong
*Assistant Examiner*—Rajnikant B. Patel
*Attorney, Agent, or Firm*—Burns, Doane, Swecker & Mathis, L.L.P.

[57] ABSTRACT

Most temperature related reference generations are in the voltage domain, which means that reference voltages rather than reference currents are generated. In some applications such as driving laser diodes, currents are needed rather than voltages. In the present invention, as an alternative, the references are designed in the current domain, wherein the operation philosopy can be said to be inverse to the operation philosopy of the prior art. The temperature dependence of the currents are known and the currents (1, 2) will be processed by linear and/or non linear operation to generate currents (3) with predetermined temperature coefficients. The advantages of the invention can be outlined as more straight forward, scaling and summation (subtraction) are much easier and simpler in the current domain than in the voltage domain.

10 Claims, 3 Drawing Sheets

METHOD AND DEVICE FOR TEMPERATURE DEPENDENT CURRENT GENERATION

TECHNICAL FIELD

The present invention relates to a method and a device for temperature dependent current generation, for example in connection with the use of laser drivers, where a very large temperature coefficient is demanded.

BACKGROUND OF THE INVENTION

Most temperature related reference generations are in the voltage domain, which means that reference voltages rather than reference currents are generated, see for example "CMOS analog circuit design" by P. Allen and D. Holberg, Holt, Rinehart and Winston Inc., 1987. In some applications such as driving laser diodes, currents are needed rather than voltages. Though the voltage references could be generated and then the currents could be derived through a resistor, the temperature dependent resistance would make the reference voltage generation relatively complicated in order to cope with the temperature dependency of the resistors.

In the international application published under the PCT: WO 95/22093 there is disclosed and shown a reference circuit, which has a controlled temperature dependence, where a reference circuit for producing an output reference current has an arbitrary predetermined temperature dependence. By adding a few currents with different temperature coefficents a current with desired temperature dependence can be achieved. Even if there is disclosed an invention of generating a current with controlled temperature dependence in the integrated form, the main idea is to generate a controlled gate source voltage, which is used to generate the drain current with controlled temperature dependence. The operation philosophy will therefore be first to generate a voltage and then at the final stage to convert the voltage into a current.

SUMMARY OF THE INVENTION

In the present invention as an alternative, references are designed in the current domain, wherein the operation philosophy is inverse to the operation philosophy of the cited prior art, because the currents are generated by deriving from well-defined voltages, i.e. the currents are first derived and then they will be manipulated. The temperature dependence of the currents are known and the currents will be processed by linear and/or non linear operation to generate currents with predetermined temperature coefficients. The advantages of the invention can be outlined as more straight forward, scaling and summation (subtraction) are much easier and simpler in the current domain than in the voltage domain, and more robust i.e. more space for manipulation, in the sense that the current is the expansion of the voltage for bipolar transistors due to the logarithmic relationship between the base-emitter voltage and collector current. A relatively small error in voltage would result in a large error in current and relatively large error in current would result in a rather small voltage error thanks to the logarithmic relationship.

DETAILED DESCRIPTION OF PREFERRED EMBODIMENTS

In silicon technologies a well defined current can be derived by using a stabilized voltage and a resistor. The base-emitter voltage $V_{be}$, thermal voltage $V_T$, gate-source voltage $V_{gs}$ and threshold voltage $V_{th}$ can be utilized. Since MOS transistors have a larger parameter spread than bipolar transistors, the use of $V_{be}$ and $V_T$ are much preferred. The generation of self-biasing $V_{be}$ an $V_T$ references can be found in "Analysis and design of analog integrated circuits", P. Gray and R. Meyer, 3rd edition, John Wiley & Sons, Inc., 1993.

Figure 1:
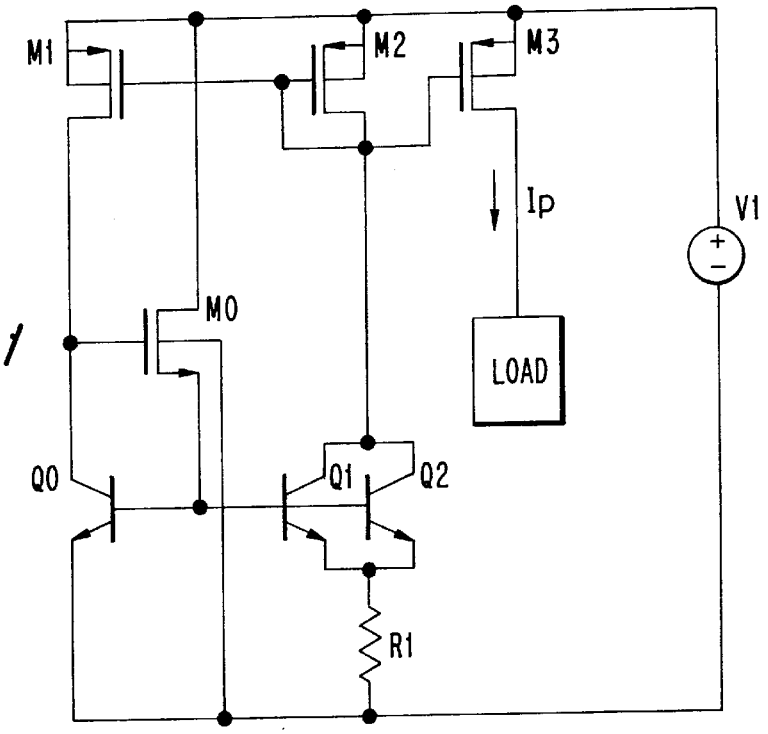
FIG. 1 shows a circuit of generating well defined currents.
Figure 2:
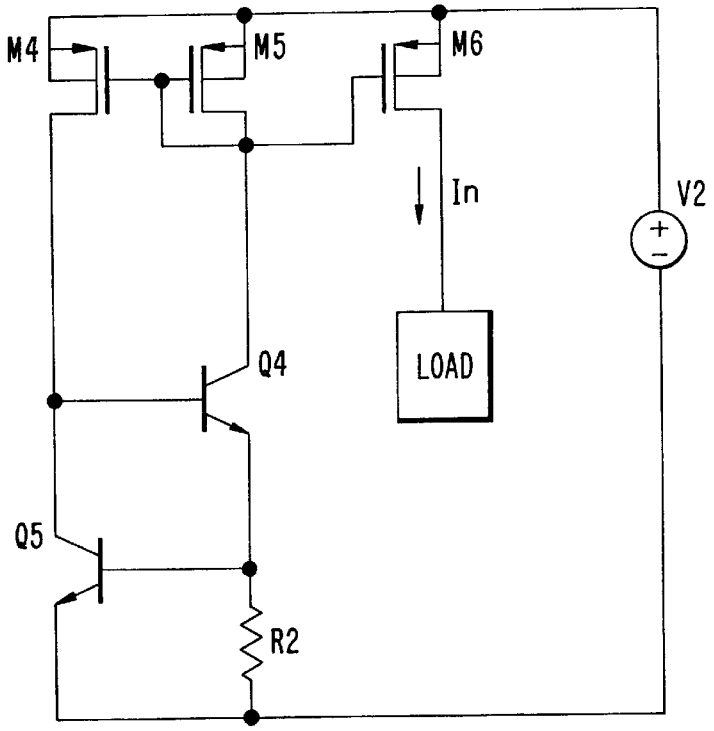
FIG. 2 shows an alternative circuit of generating well defined currents.

In FIGS. 1 and 2 circuits are shown generating well defined currents (start-up circuits are not shown).

In FIG. 1 bipolar transistors Q0, Q1 and Q2 and resistor R1 form a basic Widlar current mirror. MOS transistor M0 is added to reduce the effect of base currents of bipolar transistors. Two identical MOS transistors M1 and M2 form a current mirror, forcing the collector currents of Q0 and Q1 (plus Q2) to equal each other. MOS transistor M3 is used to output the current Ip.

In FIG. 2 two identical MOS transistors M4 and M5 form a current mirror forcing the collector currents of bipolar transistors Q3 and Q4 to equal each other. The emitter current of bipolar transistor Q4 is determined by the resistor R2 and the voltage drop across it, which is the base-emitter voltage of the bipolar transistor Q3. MOS transistor M6 is used to output the current In.

Simple calculation reveals that $$I_p = \frac{V_T}{R_1}\ln(n) \tag{1}$$

$$I_n = \frac{V_{be}}{R_2}, \tag{2}$$

where n is the emitter area ratio of transistors Q1 (plus Q2) and Q0. The fractional temperature coefficients are defined as $$TC_{I_p} = \frac{1}{I_p}\frac{\partial I_p}{\partial T} = \frac{1}{V_T}\frac{\partial V_T}{\partial T} - \frac{1}{R_1}\frac{\partial R_1}{\partial T} \text{ and} \tag{3}$$

$$TC_{I_n} = \frac{1}{I_n}\frac{\partial I_n}{\partial T} = \frac{1}{V_{be}}\frac{\partial V_{be}}{\partial T} - \frac{1}{R_2}\frac{\partial R_2}{\partial T} \tag{4}$$

At room temperature the fractional temperature coefficient of $V_T$ is about 3300 ppm/C and the fractional temperature coefficient of $V_{be}$ is about −2800 ppm/C, assuming $V_{be}$ to be about 0,7 V. In, for example our in-house process the poly resistor has a fractional temperature coefficient of −1700 ppm/C. The fractional temperature coefficient of $I_p$ is therefore about 5000 ppm/C and the fractional temperature of $I_n$ is about −1100 ppm/C. In order to have arbitrary temperature coefficients some circuit arrangements are needed.

Linear operations can be easily realized in the current domain. Suppose that $I_l=aI_p+bI_b$ (5) then the fractional temperature coefficient will be given by:

$$TC_{I_l} = \frac{1}{1+(bI_n/aI_p)} \cdot \frac{1}{I_p}\frac{\partial I_p}{\partial T} + \frac{1}{1+(aI_p/bI_n)} \cdot \frac{1}{I_n}\frac{\partial I_u}{\partial T}. \quad (6)$$

Figure 3:
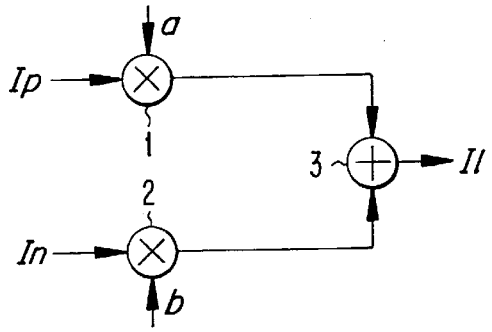
FIG. 3 shows a simplified realization according to the invention with linear operation to generate a current with a specified temperature coefficient.

From Eq (6) it can therefore be seen that by choosing different current values and scaling coefficients, it is possible to realize a current with an arbitrary fractional temperature coefficient. In FIG. 3 a block diagram is shown and in FIG. 4 an example with a=4 and b=−1 is shown.

In FIG. 3 the input currents $I_p$ and $I_n$ are multiplied by a factor of a and b in 1 and 2, respectively. The output current $I_l$ in 3 is generated by adding the two multiplied currents. The multiplication by a constant factor is realized by using current mirrors and summation of currents is done by simply connecting the currents together.

Figure 4:
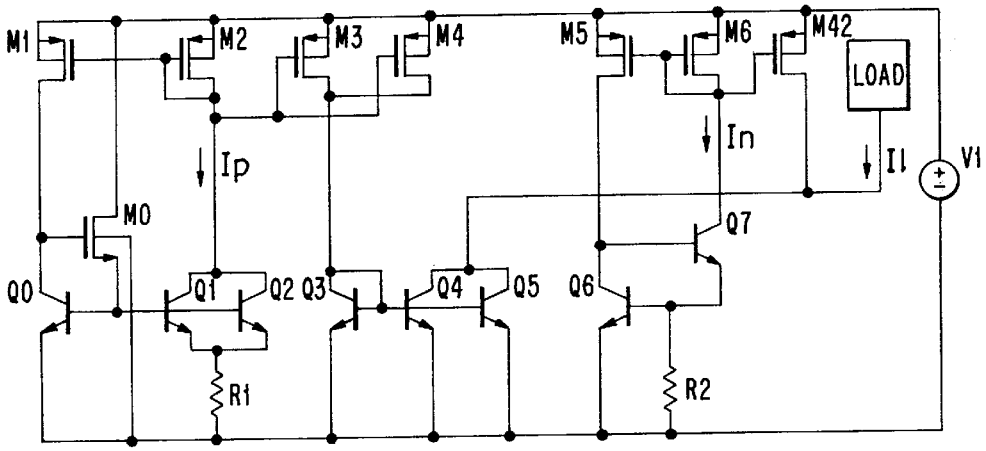
FIG. 4 shows an exemplary circuit based on the realization in FIG. 3.

In FIG. 4 bipolar transistors Q0, Q1 and Q2, resistor R1 and MOS transistors M1 and M2 generate the current $I_p$ corresponding to FIG. 1 and bipolar transistor Q6 and Q7, resistor R2 and MOS transistors M5 and M6 generate the current $I_n$ corresponding to FIG. 2. MOS transistors M3 and M4 are used to output current $I_p$ with a multiplication factor −2, assuming identical sizes for MOS transistors M1~4. Bipolar transistors Q3~5 form a current mirror and its output current is two times larger than its input current with direction reversed, assuming identical emitter area for bipolar transistors Q3~5. MOS transistor M42 is used to output current $I_n$ with direction reversed. Therefore $I_l=4I_p-I_n$.

Figure 5:
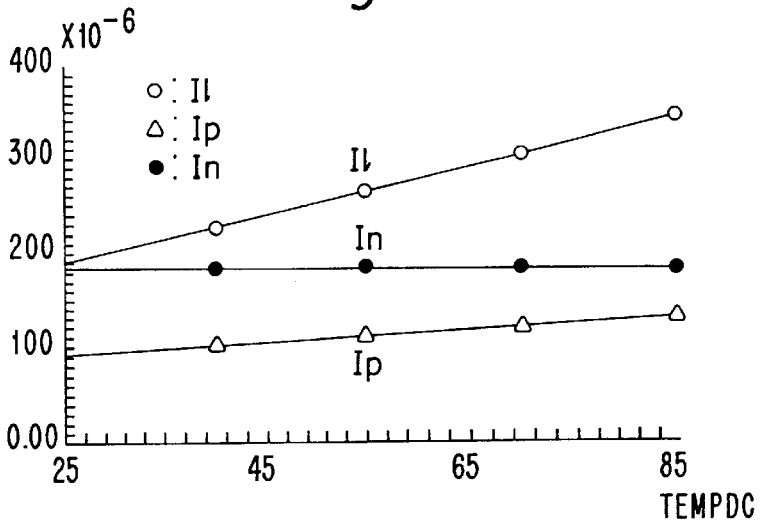
FIG. 5 shows the Hspice simulation result of the circuit in FIG. 4.

Based on the parameter of the in-house BiCMOS process, the circuit in FIG. 4 is simulated, and the simulation result is shown in FIG. 5. The fractional temperature coefficient of output current $I_l$ is 13000 ppm/C, when $I_p$ and $I_n$ have a fractional temperature coefficient of 6400 ppm/C and −340 ppm/C, respectively.

Simple non-linear operations can be utilized to change the fractional temperature coefficient as well. In the current domain a one-quadrant translinear squarer/decider only requires four bipolar transistors, as disclosed in "Analogue IC design: the current-mode approach" by C Toumazou, F. J. Lidgey and D. G. Haigh, Peter Peregrinus Ltd., 1990. Suppose that $$I_{nl} = \frac{I_p^2}{I_n}, \quad (7)$$

then the fractional temperature coefficient will be given by $$TC_{I_{nl}} = \frac{1}{I_{nl}}\frac{\partial I_{nl}}{\partial T} = 2 \cdot \frac{1}{I_p}\frac{\partial I_p}{\partial T} - \frac{1}{I_n}\frac{\partial I_n}{\partial T}. \quad (8)$$

It can be seen from, e.g. (8), that by using simple nonlinear operation the fractional temperature coefficient can be changed as well.

Figure 6:
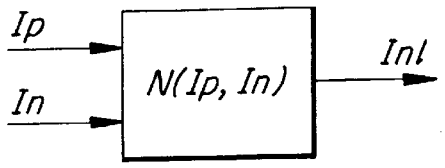
FIG. 6 shows a simplified realization according to the invention with nonlinear operation to generate a current with a specified temperature coefficient.
Figure 7:
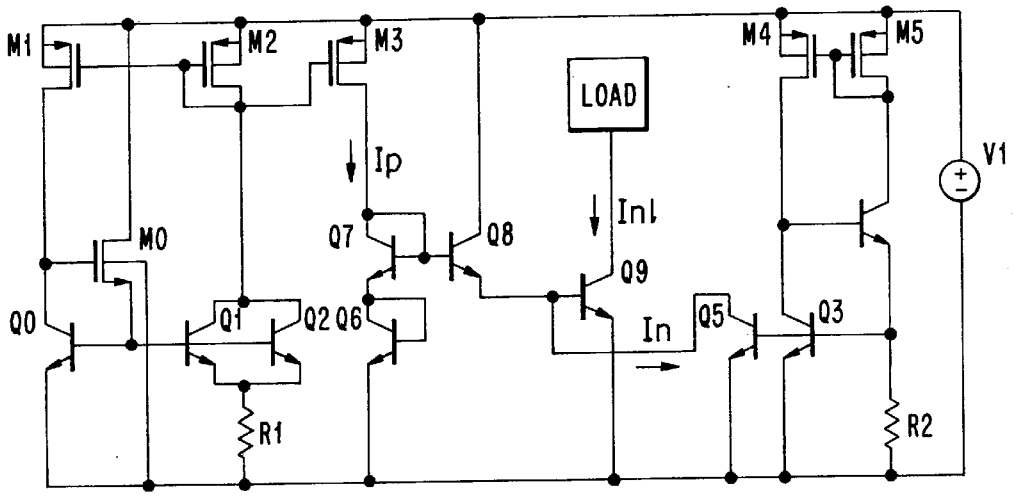
FIG. 7 shows an exemplary circuit based on the realization in FIG. 6.

In FIG. 6 a block diagram is shown generating a current $I_{n1}$ by using nonlinear operation on the two input currents $I_p$ and $I_n$, and the nonlinear operation can be the one defined by Eq (7). A circuit is shown in FIG. 7 wherein bipolar transistors Q0, Q1 and Q2, resistor R1, and MOS transistors M1 and M2 generate the current $I_p$ corresponding to FIG. 1, and bipolar transistors Q6 and Q7, resistor R2, and MOS transistors M5 and M6 generate the current $I_n$ corresponding to FIG. 2. MOS transistor M3 is used to output the current $I_p$ (assuming the same size for M1~3), and bipolar transistor Q5 is used to output the current $I_n$ (assuming the same size for Q3 and Q5). Bipolar transistors Q6~9 realize the one-quadrant translinear square/divider.

Figure 8:
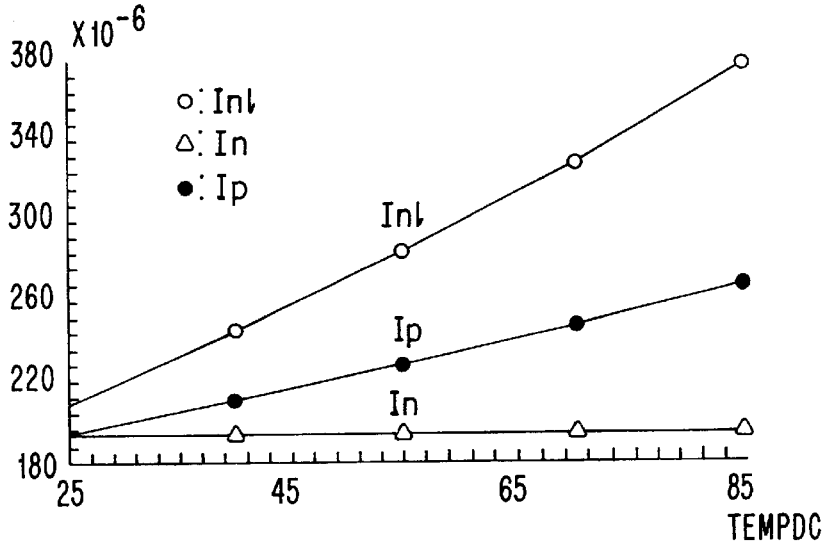
FIG. 8 shows the Hspice simulation result of the circuit in FIG. 7.

Based on the parameter of the in-house BiCMOS process, the circuit on FIG. 7 is simulated, and the simulation result is shown in FIG. 8. The fractional temperature coefficient of output current $I_{n1}$ is 13500 ppm/C, when $I_p$ and $I_n$ have a fractional temperature coefficient of 6300 ppm/C and −143 ppm/C, respectively.

While the foregoing description includes numerous details and specificities, it is to be understood that these are merely illustrative of the present invention, and are not to be construed as limitations. Many modifications will be readily apparent to those skilled in the art which do not depart from the spirit and scope of the invention, as defined by the appended claims and their legal equivalents.

I claim:

1. A method for generating a current having a predetermined temperature coefficient, said method comprising the steps of:

generating first and second currents having well-defined temperature coefficients;

multiplying said first and second currents with scaling factors; and adding said multiplied currents to form an output current having a predetermined temperature coefficient.

2. The method of claim 1 wherein said predetermined temperature coefficient can be changed by varying values of said first and second currents or said scaling factors.

3. A method for generating a current having a predetermined temperature coefficient, said method comprising the steps of:

generating first and second currents having well-defined temperature coefficients; and processing said first and second currents with a one-quadrant translinear squarer/divider to produce an output current having a predetermined temperature coefficient.

4. The method of claim 3 wherein said predetermined temperature coefficient can be varied by varying values of said first and second currents.

5. A system for generating a current having a predetermined temperature coefficient comprising:

means for generating a first current and a second current, each current having a well-defined temperature coefficient;

means for multiplying said first current and said second current by a factor a and b, respectively; and means for adding said multiplied currents together to form an output current having a predetermined temperature coefficient.

6. The system of claim 5 wherein said predetermined temperature coefficient can be changed by varying values of said first and second currents or said factors.

7. A system for generating a current having a predetermined temperature coefficient comprising:

means for generating first and second currents having well-defined temperature coefficients; and a one-quadrant translinear squarer/divider for processing said first and second currents to produce an output current having a predetermined temperature coefficient.

8. The system of claim 7 wherein said predetermined temperature coefficient can be varied by varying values of said first and second currents.

9. A method for generating a current having a predetermined temperature coefficient, said method comprising the steps of:

generating first and second currents having well-defined temperature coefficients;

processing said first and second currents to produce an output current having a predetermined temperature coefficient, wherein said output current is produced via one of a linear and non-linear operation.

10. A system for generating a current having a predetermined temperature coefficient comprising:

means for generating first and second currents having well-defined temperature coefficients;

means for processing said first and second currents to produce an output current having a predetermined temperature coefficient, wherein said output current is produced via one of a linear and non-linear operation.

* * * * *